US005684501A

United States Patent [19]

Knapp et al.

[11] Patent Number: 5,684,501

[45] Date of Patent: Nov. 4, 1997

[54] ACTIVE MATRIX DISPLAY DEVICE AND METHOD OF DRIVING SUCH

[75] Inventors: Alan G. Knapp, Crawley; John M. Shannon, Whyteleafe; Alexander D. Annis, Haywards Heath; Jeremy N. Sandoe, Horsham, all of England

[73] Assignee: U.S. Philips Corporation, New York, N.Y.

[21] Appl. No.: 401,839

[22] Filed: Mar. 10, 1995

[30] Foreign Application Priority Data

| | | | |
|---|---|---|---|
| Mar. 18, 1994 | [GB] | United Kingdom | 9405421 |
| Nov. 21, 1994 | [GB] | United Kingdom | 9423474 |

[51] Int. Cl.[6] ..... G09G 3/34

[52] U.S. Cl. ..... 345/94; 345/97; 345/208; 359/54

[58] Field of Search ..... 359/55, 56, 61, 359/63, 93, 98, 100, 104, 900; 345/94, 97, 208; 348/792, 793

[56] References Cited

U.S. PATENT DOCUMENTS

| | | | |
|---|---|---|---|
| 4,710,768 | 12/1987 | Takeda et al. | 340/805 |
| 4,728,947 | 3/1988 | Ayliffe et al. | 340/805 |
| 4,870,398 | 9/1989 | Bos | 340/784 |
| 5,032,830 | 7/1991 | Koijk | 340/784 |
| 5,159,325 | 10/1992 | Kuijk et al. | 340/783 |

FOREIGN PATENT DOCUMENTS

| | | | |
|---|---|---|---|
| 0523797 | 1/1993 | European Pat. Off. | G09G 3/36 |
| 0616311 | 9/1994 | European Pat. Off. | G09G 3/36 |
| 2129182 | 5/1984 | United Kingdom | G09G 3/34 |

*Primary Examiner*—Glenton B. Burgess
*Attorney, Agent, or Firm*—Robert J. Kraus

[57] ABSTRACT

In an active matrix display device having an army of electro-optic, e.g. liquid crystal, display elements (12) which are each connected in series with a two-terminal non-linear device (15), such as a MIM type thin film diode, between associated row and column address conductors (16,17), and are driven by a circuit, (20,22) to produce a display effect by applying a selection signal to each row address conductor in turn and data signals to the column address conductors, a selection signal comprising a voltage pulse signal whose magnitude is increased gradually and in a controlled fashion to a maximum selection voltage amplitude is used so as to reduce the extent of ageing in the non-linear devices and differential ageing effects on display elements driven to different levels over a period of use by reducing peak currents flowing through the non-linear devices. The rising edge of the selection pulse signal is suitably shaped, for example by ramping or stepping, for this purpose. When using a five level row drive waveform comprising positive and negative selection signals and a reset signal, the reset selection signal can be shaped in this way, preferably together with the selection signal of opposite polarity.

21 Claims, 7 Drawing Sheets

ACTIVE MATRIX DISPLAY DEVICE AND METHOD OF DRIVING SUCH

BACKGROUND OF THE INVENTION

This invention relates to an active matrix display device comprising sets of row and column address conductors, a row and column array of electro-optic display elements operable to produce a display, each of which is connected in series with a two terminal non-linear device between a row conductor and a column conductor, and a drive circuit connected to the sets of row and column address conductors for applying selection voltage signals to the row address conductors to select the rows of display elements and data voltage signals to the column address conductors to drive the selected display elements to produce a required display effect. The invention relates also to a method of driving such a matrix display device.

The display device may be a liquid crystal display device used to display alpha-numeric or video information and the two terminal non-linear devices commonly used in such matrix display devices comprise thin film diode devices such as MIMs or back to back diodes which are bidirectional and substantially symmetrical. The display elements are addressed by sequentially applying a selection voltage signal to each one of the set of row address conductors in turn and applying in synchronised relationship data signals to the other set as appropriate to drive the display elements to a desired display condition which is subsequently maintained until they are again selected in a following field period.

Display devices of the above kind and methods of driving such are described in U.S. Pat. No. 5,159,325 and GB-A-2129182. The method described in GB-A-2129182 entails the application of a four level row drive waveform to each row address conductor comprising a selection voltage level for a row selection interval of fixed duration followed by a second, hold, voltage level of less value but of the same polarity as the selection level and which is maintained for at least a major portion of the time which elapses until the row conductor is next addressed. The polarity of the selection and hold levels is inverted for successive field periods. In the method described in U.S. Pat. No. 5,159,325 a five level row scanning drive waveform is employed which includes a reset voltage signal in addition to the usual selection signals and non-selection (hold) levels. The selection and hold levels are changed for successive fields and, together with the reset voltage signal, which may be regarded as an additional selection signal, require a five level signal waveform. Before presenting a selection signal, which together with the data signals provides the display elements of a row with a voltage of a certain sign, the display elements are charged through their non-linear devices, which have an approximately symmetrical I-V characteristic, to an auxiliary voltage level of the same sign and which lies at or beyond the range of voltage levels (Vth to Vsat) used for display. This method leads to a reduction of non-uniformities (grey variations) in the transmission characteristics of display elements which can otherwise occur when driving the rows with periodical inversion of the polarity of both the selection and the non-selection signals, simultaneously with inversion of the data signals.

The drive scheme of U.S. Pat. No. 5,159,325 helps to compensate for the effects of differences in the operating characteristics of the non-linear devices of the display device. Ideally, the non-linear devices of the display device should demonstrate substantially identical threshold and I-V characteristics so that the same drive voltages applied to any display element in the array produce substantially identical visual results. Differences in the thresholds, or turn-on points, of the non-linear devices can appear directly across the electro-optical material producing different display effects from display elements addressed with the same drive voltages. Serious problems can arise if the operational characteristics of the non-linear devices drift over a period of time through ageing effects causing changes in the threshold levels. The voltage appearing across the electro-optic material depends on the on-current of the non-linear device and if the on-current changes during the life of the display device then the voltage across the electro-optic material also changes. This change may either be in the peak to peak amplitude of the voltage or in a mean d.c. voltage depending on the actual drive scheme. The consequential change in display element voltages not only leads to inferior display quality but can cause an image storage problem and also degradation of the LC material.

In European Patent Specification EP-A-0523797 there is described a display device of the above kind which further includes a reference circuit comprising a capacitor connected in series with a non-linear device like those of the display elements and to which is applied drive signals similar to those applied to the display elements. Changes in the way in which the non-linear device of the reference circuit behaves reflect behavioural changes in the non-linear devices of the display elements and by monitoring the characteristics of the non-linear device of the reference circuit, correction can be made so as to compensate for the corresponding changes in the on-current of the display element non-linear devices due to ageing processes. To this end, a reference voltage is applied to the reference circuit simulating a data signal which corresponds to a predetermined average data signal level or is derived from actual data signals applied to column conductors over a period of time. However because the drift rate is a function of drive level this feedback technique can only compensate for the average drift level. While such a monitoring circuit can be used to compensate for changes in the non-linear device characteristic over time for one drive level, it is, of course, desirable that the magnitude of any drift should be as small as possible. This is especially true if the display device displays different brightness levels in different areas for prolonged periods. The feedback technique will compensate for the average drift but the difference between the areas will produce different amounts of drift which will eventually produce a remanent, burnt-in, pattern corresponding to the original image. This effect may be minimised if the difference in drift between areas of the image having different brightness levels is minimised.

SUMMARY OF THE INVENTION

It is one object of the present invention to provide an improved matrix display device and method of driving such which can lead to a reduction in the ageing effects of the non-linear devices.

According to one aspect of the present invention, there is provided a method of driving an active matrix display device having sets of row and column address conductors and an array of electro-optic display elements operable to produce a display each of which is connected in series with a two terminal non-linear device between a row address conductor and a column address conductor, in which a selection voltage signal is applied to each row address conductor during a row selection period to select a row of display elements and data voltage signals are applied to the column address conductors whereby the selected display elements are driven to voltage levels according to the data voltage signals, which is characterised in that the selection signal supplied to a row address conductor comprises a voltage pulse signal whose magnitude increases gradually in a controlled fashion to a maximum selection voltage amplitude during the row address period.

According to another aspect of the present invention there is provided an active matrix display device comprising sets of row and column address conductors, an array of electro-optic display elements operable to produce a display, each of which is connected in series with a two-terminal non-linear device between a row address conductor and a column address conductor, and a drive circuit connected to the sets of row and column address conductors for applying a selection voltage signal to each row address conductor during a row address period to select a row of display elements and data signals to the column address conductors by means of which the selected display elements are driven to voltage levels according to the data voltage signals, characterised in that the drive circuit is adapted to provide selection voltage signals for supply to the row address conductors which comprise a voltage pulse signal whose magnitude increases gradually in a controlled fashion to a maximum selection voltage amplitude during the row address period.

The row drive waveform used in driving the display elements, and in particular the selection signals, thus differs from conventionally-used row drive waveforms in which the selection signal comprises a voltage pulse signal whose leading edge has a rapid and uncontrolled rise time. In practice the leading (rising) edge of these pulse signals will have an ill-defined rise time in view of intrinsic impedances, for example, in the connections linking the drive circuit to the row address conductors and the resistance of the row address conductors themselves but nevertheless the rise time will be rapid as these impedances are normally minimised in order to prevent unwanted effects such as non-uniformity and cross-talk. By using instead a modified row drive waveform comprising selection signals in the form of voltage pulse signals whose magnitude gradually increases in a controlled manner to a predetermined maximum level, rather than in a rapid, uncontrolled manner as in the case of the selection signals in known row drive waveforms, the peak current which flows through a non-linear device during the display element charging period is reduced. Through studies on the ageing effects on non-linear devices comprising thin film diodes such as MIM type devices using non-stoichiometric amorphous silicon alloys (e.g. $Si_xN_y$) it has been found that the ageing is dependent on the peak current which flows through the device. In reducing this current, therefore, the extent of ageing of the non-linear device over a period of time of operation is correspondingly reduced. Importantly, it is also found that the difference in ageing between the non-linear devices of display elements driven to different levels is also significantly reduced. The invention involves the recognition that while for a given display element and non-linear device configuration and a given electro-optic, e.g. liquid crystal, material the total charge which must flow through the non-linear device to achieve a given display element voltage, and hence transmission level, cannot be changed, the current waveform can be altered.

By virtue of the changes in the non-linear device I-V characteristics through ageing being reduced, the differential ageing between areas of different brightness is consequently reduced. Moreover, the need to use a compensation scheme such as that described in EP-A-0523797 could be avoided or at least the amount of compensation needed can be reduced.

The required form of the selection signal can be achieved in a variety of ways. The rising edge of the pulse signal can be stepped, either with a single step or with a plurality of steps at progressively higher voltage levels. Alternatively, the rising edge of the pulse signal may be ramped smoothly, either in a linear or a non-linear manner. In all cases, the pulse signal is preferably held at a maximum level for a latter part of the duration of the pulse signal. In a particularly preferable embodiment the pulse signal initially increases rapidly to a predetermined level below the maximum level and thereafter is increased to the required maximum level, for example, by ramping or by a plurality of steps which maximum level is held for a short period comprising the latter part of the duration of the pulse signal. This has the advantage that, with the shape of the rising edge suitably adjusted, the charging current supplied through the non-linear devices to a display element during the selection period tends towards a substantially constant level.

The invention may be applied to a drive scheme using a four level row drive waveform in which the polarity of the selection voltage signal is inverted in successive fields.

Preferably, however, the display device is driven using a five level row drive waveform which, in addition to the aforementioned selection voltage signal which is operable to drive a selected display element to a voltage of first polarity, includes a second selection voltage signal which is operable to drive the display element to a voltage of the opposite polarity to that obtained by the first mentioned selection signal, again to produce a required display effect, and a reset selection which precedes the second selection signal and is operable to drive the display element to a voltage of said opposite polarity whose level lies at or beyond the range used for display purposes. As previously described, this kind of waveform has the advantage of correcting for the differences in the I-V. characteristics of the non-linear devices such that the RMS voltage across the display elements is substantially independent of those differences. In this case, the reset selection signal and/or the second selection signal may similarly comprise voltage pulse signals whose magnitudes increase gradually and in a controlled fashion to a maximum amplitude to reduce still further the possibility of ageing of the non-linear devices and differential ageing effects. Considering, for example, a case where the first-mentioned selection voltage signal and the second selection voltage signal comprise negative and positive selection signals respectively and a positive reset selection signal is used which precedes the positive selection signal, then both the positive selection signal and the reset selection signal in addition to the negative selection signal may be tailored so as to increase in magnitude gradually as well, using any of the above described shaping techniques.

In a particularly preferred embodiment using a five level row drive waveform which is particularly advantageous where fixed patterns are displayed for prolonged periods, as, for example, occurs in datagraphic displays or TV displays where stationary symbols, patterns, or the like are superimposed on the TV picture, the first-mentioned, e.g. negative selection signal and the, e.g. positive, reset signal are both shaped in the above described manner while the second, positive, selection signal, which follows the reset signal, comprises a voltage pulse signal whose leading edge, rises rapidly to a maximum amplitude, for example a substantially rectangular voltage pulse of the kind used previously. This manner of operation assists in reducing the difference in drift in the non-linear devices associated with display elements which are driven to different drive voltage levels for prolonged periods, and a burn-in effect produced thereby. Burn-in is caused by the difference in drift between display elements during prolonged display. The five level row waveform drive scheme can correct for differences in TFD characteristics produced by this drift but converts the differential drift to a DC level. In this embodiment, differential drift and burn-in are reduced and may be eliminated. Considering the case, for example, of liquid crystal display elements driven to produce black and white outputs and in which, using crossed polarisers, comparatively large and small amounts of charge respectively are passed through their associated non-linear devices, then by using the kind of row drive waveform of this particular embodiment, with, for example, the negative selection voltage signal and the positive reset signal both being shaped so as to increase in magnitude gradually and with the positive selection signal following the reset signal not being shaped in this way but having a rapidly rising leading edge, then the resulting peak current pulses through the non-linear devices during the negative selection and positive reset periods are comparatively small in amplitude for both black and white display elements while the current pulses during the positive selection periods for a white display element are significantly peaked, and considerably larger than those for black display elements in those periods. The different forms of the current pulses for the black and white display elements respectively thus obtained, with the current pulses for a white display element during positive selection periods deliberately enlarged, means that the difference in ageing caused to the non-linear devices associated with black and white display elements is reduced to a low level even though the amount of charge transferred for the black display elements is greater than that for the white display elements.

In another embodiment using a five level row drive waveform, just the reset selection signal may be shaped so as to increase in magnitude gradually and in controlled fashion. This would result in a decrease in the overall ageing effect in the non-linear devices and possibly a small reduction in differential ageing as well, but the benefits would not be as great as with the aforementioned preferred embodiment.

The invention is particularly applicable to active matrix liquid crystal display devices but it is envisaged that it can be used also for display devices employing other types of electro-optical materials and two terminal non-linear switching devices.

BRIEF DESCRIPTION OF THE DRAWING

Active matrix display devices, and in particular liquid crystal display devices, and methods of driving such, in accordance with the invention, will now be described, by way of example, with reference to the accompanying drawings in which.

The same reference numerals are used throughout the Figures to indicate the same or similar parts.

DESCRIPTION OF THE PREFERRED EMBODIMENTS

Figure 1:
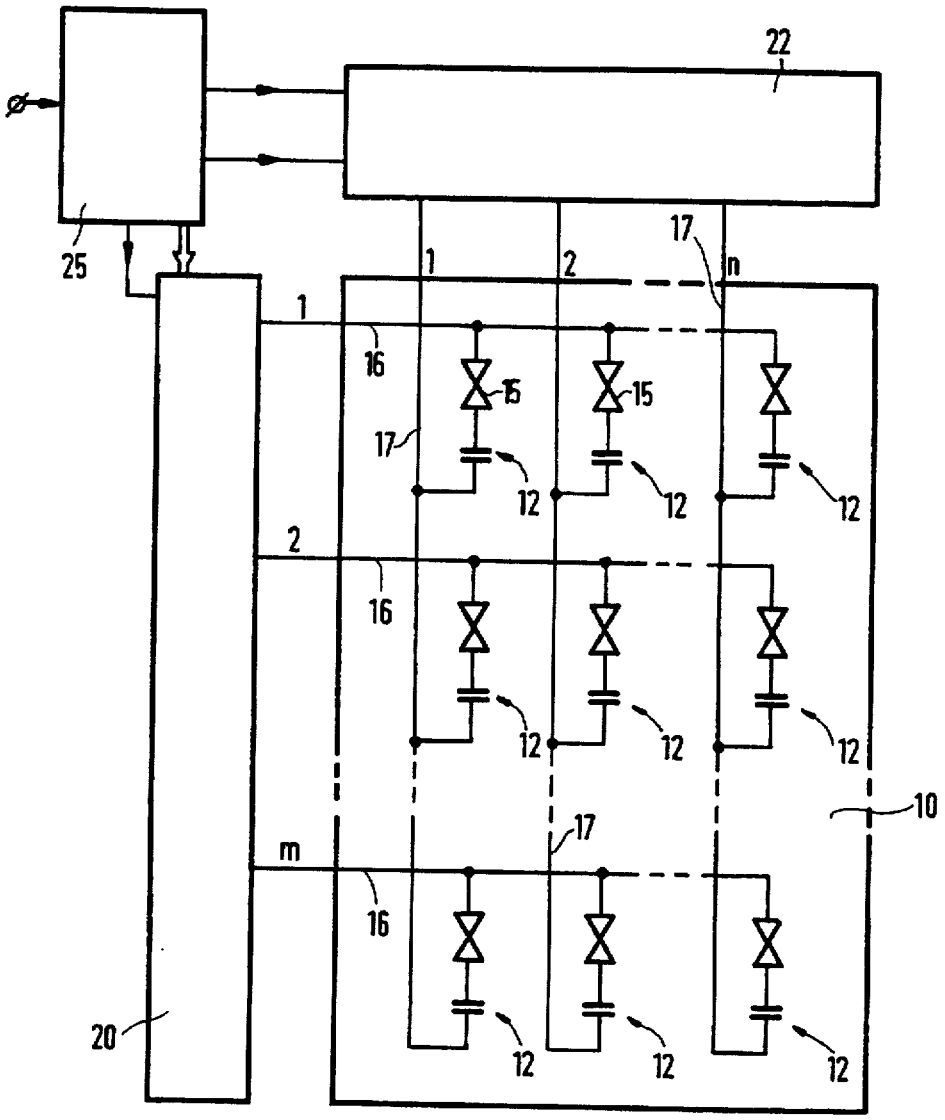
FIG. 1 is a simplified block diagram of an active matrix liquid crystal display devise.

Referring to FIG. 1, the display device, which is intended for datagraphic or TV display purposes, comprises an active matrix addressed liquid crystal display panel 10 of conventional construction and consisting of m rows (1 to m) with n display elements 12 (1 to n) in each row. Each display element 12, represented as a capacitor, comprises a liquid crystal display element consisting of two spaced electrodes with twisted nematic liquid crystal material therebetween, and is connected electrically in series with a bidirectional non-linear resistance device 15 between a row address conductor 16 and a column address conductor 17. The non-linear device 15 exhibits a substantially symmetrical threshold characteristic and functions in operation as a switching element. The display elements 12 are addressed via sets of row and column conductors 16 and 17 carried on respective opposing faces of two, spaced, glass supporting plates (not shown) also carrying the opposing electrodes of the liquid crystal display elements. The devices 15 are provided on the same plate as the set of row conductors 16 but could instead be provided on the other plate and connected between the column conductors and the display elements.

The row conductors 16 serve as scanning electrodes and are addressed by a row driver circuit 20 which applies to the row conductors a row drive waveform including a selection signal such that a selection signal is applied to each row conductor 16 sequentially in turn. In synchronism with the selection signals, data signals are applied to the column conductors 17 from a column driver circuit 22 to produce the required displays from the rows of display elements as they are scanned. The selection signal for each row occurs in a respective row address period in which the optical transmissivity of the display elements 14 of the selected row are set to produce the required visible display effects according to the values of the data signals present on the conductors 17. The individual display effects of the display elements 14, addressed one row at a time, combine to build up a complete picture in one field, the display elements being repeatedly addressed in subsequent fields. Using the transmission/voltage characteristics of a liquid crystal display element grey scale levels can be achieved. The polarity of the data signal voltages for any given row of display elements is reversed in successive fields to reduce image sticking effects.

The row and column driver circuits 20 and 22 are controlled by a timing and control circuit, generally referenced at 25, to which a video signal is applied and which comprises a video processing unit, a timing signal generation unit and a power supply unit. The row driver circuit 20, like known row driver circuits, comprises a digital shift register and switching circuit to which timing signals and voltages determining the row drive waveforms are applied from the circuit 25. The column driver circuit 22 is of conventional form and, like known column driver circuits, comprises one or more shift register/sample and hold circuits. The circuit 22 is supplied by the video processing unit of circuit 25 with video data signals derived from an input video signal containing picture and timing information. Timing signals are supplied by the circuit 25 to the circuit 22 in synchronism with row scanning to provide serial to parallel conversion appropriate to the row at a time addressing of the panel 10.

The non-linear devices 15 comprise thin film diodes, which in this embodiment consist of MIMs. However other forms of bidirectional non-linear resistance devices exhibiting a threshold characteristic, for example, back to back diodes, or other diode structures such as MSM (metal-semiconductor-metal), n-i-n or p-i-p structures may be used instead. All such non-linear devices have an approximately symmetrical I-V characteristic.

Figure 2:
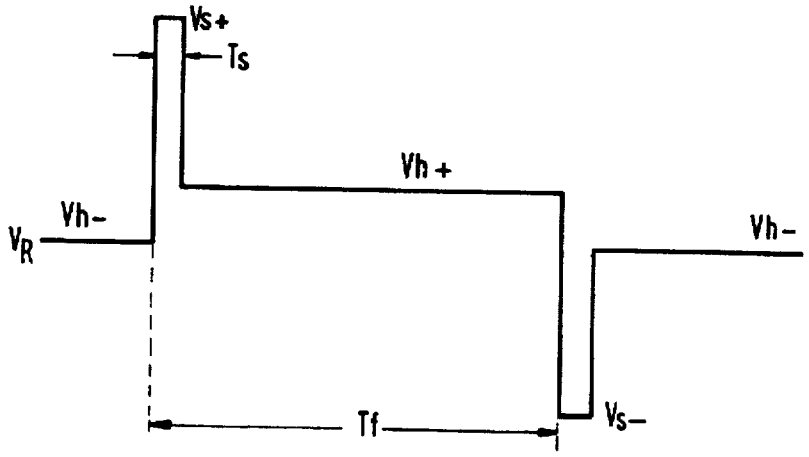
FIGS. 2 and 3 illustrate schematically examples of two kinds of row drive waveforms which have been used previously.

The general nature of the row drive waveforms used for driving the display device are, apart form certain differences which will be described, similar to known kinds of row drive waveforms such as those described either in GB-A-2129182 or in U.S. Pat. No. 5,159,325, to which reference is invited and whose disclosures are incorporated herein. In the drive scheme described in GB-A-2129182 row scanning is accomplished using a row drive waveform of the kind depicted in FIG. 2 and which is referred to herein as a four level row drive scheme. The voltage waveform $V_R$ applied to a row conductor comprises a row selection signal portion of a duration, Ts, corresponding to a row address period which, in the case of a TV display, will be less than a TV line period, e.g. 64 microseconds for a PAL system, and of magnitude Vs followed immediately by a hold signal portion of lower, but similar polarity, voltage, Vh, for the remainder of the field period Tf. In this example, the display device is driven with field inversion so that the hold and select signal portions alternate between Vh+ and Vh− and Vs+ and Vs− respectively making four levels altogether. The display elements can be addressed using a line inversion mode of drive to reduce perceived flicker.

Figure 3:
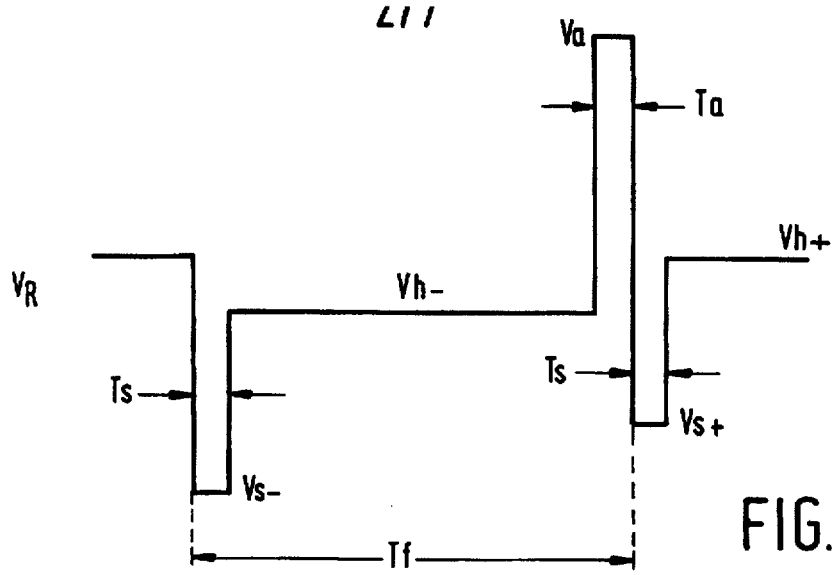

The drive scheme described in U.S. Pat. No. 5,159,325 differs from the above scheme in that, in addition to the usual selection voltage signals followed by hold, (non-selection), voltage levels, the row drive waveform further includes a reset voltage signal which immediately precedes a selection signal for the purpose of correcting for the effects of non-uniformities in the behaviour of the non-linear devices across the array. The reset voltage signal can be regarded as an additional selection signal and as a result of the reset voltage signal, a display element is, in alternate fields, charged (this term being used herein to include discharge where appropriate) to an auxiliary voltage level, which lies beyond one end of the range of display element voltages used for display, just before the display element is set to the required voltage level of the same sign, but of lower magnitude than the auxiliary voltage level, by the application of a following selection voltage signal together with the data voltage signal to the column conductor. In intermediate fields, the display element is driven with a single selection signal and an inverted data voltage signal to drive the display element to a voltage of opposite polarity to that achieved by the selection signal following the reset signal. This kind of row drive scheme is referred to herein as a five level row drive scheme. An example of the row drive waveform, $V_R$, in this case using a positive reset pulse signal, is illustrated in FIG. 3. In one field period a negative selection voltage signal $V_s-$ of a duration Ts is presented to a row conductor 16 during a row address period while a data voltage is presented to a column conductor 17, with respective data voltages being applied to each of the other column conductors at the same time, as a result of which the display element 12 at the intersection of the row and column conductors concerned is charged through its associated non-linear device 15 to, for example, a positive voltage whose magnitude is dependent on the level of the data signal. Upon termination of the selection signal, a non-selection, hold, level $V_h-$ is applied to the row conductor until just before the next selection of the row in the subsequent field. To reduce visible flicker effects, data having an alternating sign is presented to a display element in successive fields. In the next field, therefore, the display element is charged to a negative voltage by presenting a positive selection signal. Immediately before this next selection, and in a row address period of the preceding row of display elements, a positive reset selection voltage Va is applied for a reset period Ta, which normally would be slightly longer than Ts, as a result of which the display element is charged negatively through the non-linear device to an auxiliary voltage, dependent on the reset voltage level and the level of the data signal then present on the column address conductor that lies at or beyond the range of operating voltages used for display (i.e. up to a value less than or equal to Vsat, its black level). The display element is then charged, in the next field period, to the required display value by means of the immediately following, positive selection voltage signal Vs+ applied to the row conductor 16 in the subsequent row address period while an inverted data voltage is presented to the column conductor 17. Upon termination of this positive selection signal a non-selection, hold, level Vh+ is applied. In this way, the voltage across the display elements is inverted every field, and the selected display elements are charged to the required voltages, at which a desired display state is obtained, by passing current in the same direction through the non-linear devices, while the passage of current when the display elements are charged to the auxiliary level is in the opposite direction. The duration, Ts, of each of the selection pulse signals Vs− and Vs+ is slightly less than the line period, TI, of the incoming video signal, e.g. 32 microseconds for a datagraphic display, which corresponds to the row address period and slightly less than the duration of the data signal. Tf in FIG. 3 represents a field period, e.g. approximately 16 ms.

With this drive scheme, the display elements are driven in a line inversion mode of operation in which, in addition to the column drive voltages applied to a display element being reversed in polarity every field, the drive voltages applied to one row of display elements are shifted over one field period plus a row address period with respect to those for an adjacent row and the data signals are inverted for successive rows. The reset voltage pulse Va in the described example is positive of course, the sign of all the operating voltages, including the data signals could be reversed, thereby giving a negative reset signal. Also, the sign of all the operating voltages applied to a row of display elements can periodically be changed during operation if desired, for example after a fixed number of frames. A modified form of this five level row drive scheme which could also be used is described in EB-A-0616311.

In these known drive schemes, the selection signals are substantially rectangular voltage pulse signals. Although the leading edges of the pulse signals would not be exactly vertical, due to intrinsic impedances in the row drive circuit 20 and interconnections to the row address conductors 16, they are very nearly vertical. The magnitude of the selection pulse signal rises in a rapid, uncontrolled manner with the rise time itself being rapid and ill-defined.

Referring now again to FIG. 1, the drive circuit of the display device of FIG. 1, and in particular the row driver circuit 20, is adapted to provide a row drive waveform in which the selection signals comprise voltage pulse signals whose magnitude increases gradually and in a controlled way to a predetermined maximum. More particularly, the leading (rising) edge of a selection pulse signal is shaped such that it now has a controlled rise time and the rate of rise of the selection signal is reduced compared with those of the known row drive waveforms.

FIGS. 4, 5 and 6 illustrate schematically various alternative forms which the selection signal components of the row drive waveforms may take.

Figure 4A:
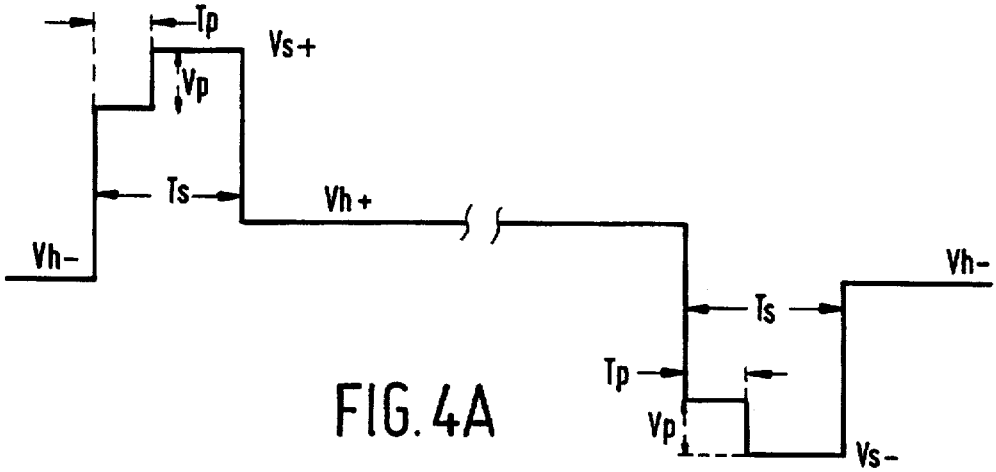
FIGS. 4A–6C illustrate schematically examples of the selection signal components of the row drive waveform used in the present invention.
Figure 4B:
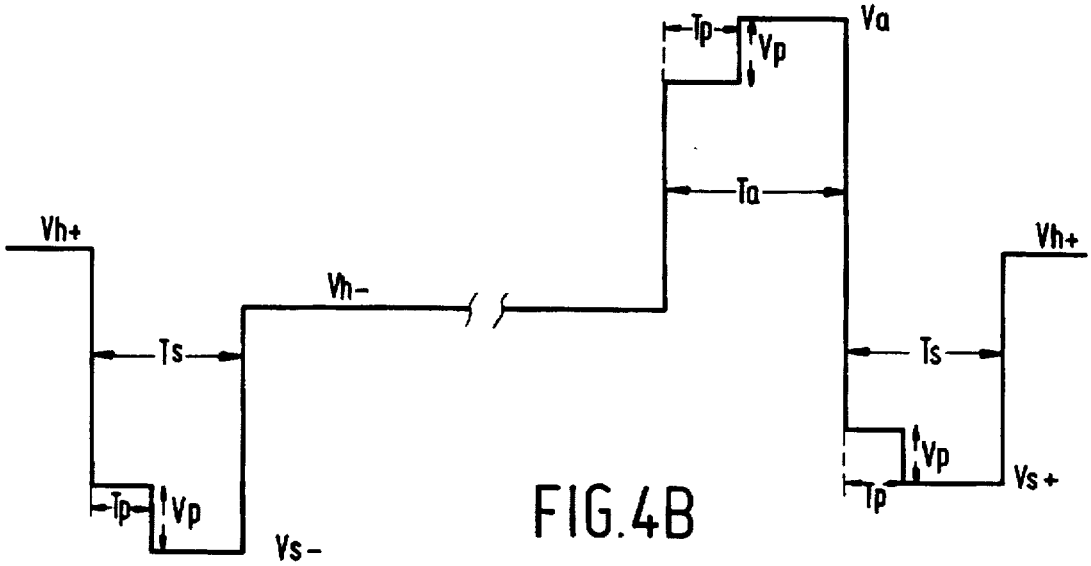

In the form shown in FIG. 4, a step is introduced into the rising edge of the selection pulses. FIGS. 4A and 4B illustrate examples of stepped selection pulse signals in the case of a four level and a five level row drive scheme respectively for both the positive and negative selection signals of the waveform. In this approach, the voltage of the selection signals initially increases rapidly, almost instantaneously, but only to a value below the required maximum and is then held for a period Tp before being increased, again rapidly, to a maximum for the remainder of the selection pulse period Ts. In the five level drive scheme, FIG. 4B, the reset pulse Va is also shown stepped in a similar manner.

Figure 5A:
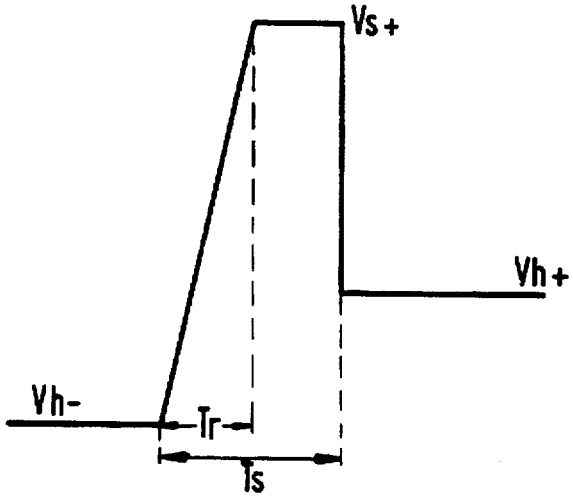
Figure 5B:
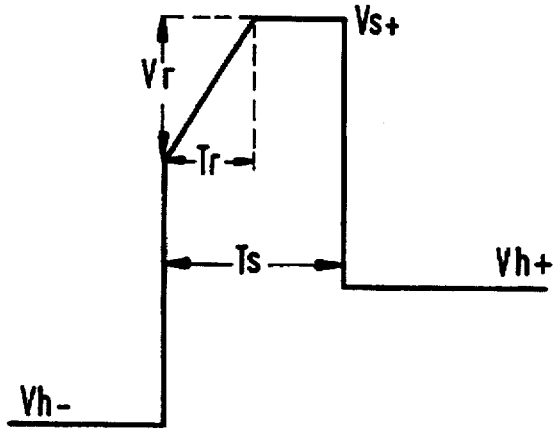
Figure 5C:
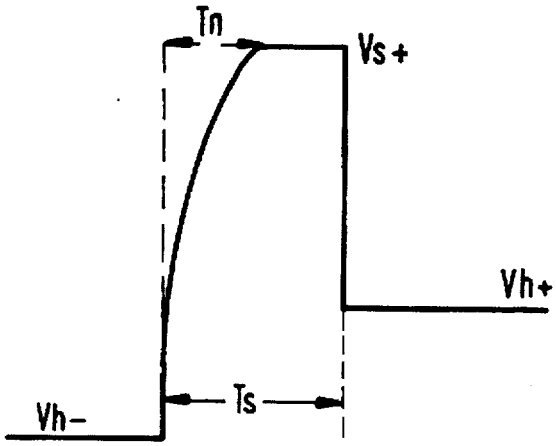

FIG. 5 illustrates examples of modified selection pulse signals which involve altering the form of the rising edge in a variety of other, ways such that the magnitude increases gradually and in a controlled manner to a predetermined maximum. Only a positive selection signal is shown for each example but it should be understood that the same shaping principles can be used also for the negative selection pulse signals, and applied to both four and five level row drive schemes. In the latter case, the reset pulse signal may be similarly altered as well. In FIG. 5A, the voltage is ramped so that it gradually increases linearly and smoothly over a ramp period Tr to a maximum Vs+ and is then maintained for the remainder (Ts-Tr) of the selection period Ts. In FIG. 5B, the voltage is initially increased rapidly to a certain level below the maximum Vs+ and is then gradually ramped linearly and smoothly to the maximum over a ramp period Tr to the maximum and then held for the remainder (approximately Ts-Tr) of the selection period Ts. In FIG. 5C, the voltage is gradually increased smoothly and non-linearly by ramping over an initial period Tn, the rising edge of the selection pulse signal consequently being of variable slope (curved), until the maximum Vs+ is reached after which it is held at this level for the remainder of the selection period Ts.

Figure 6A:
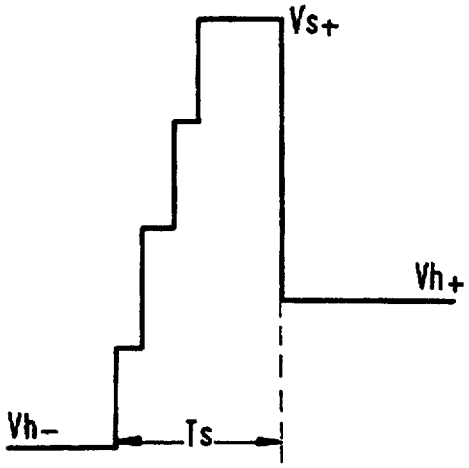
Figure 6B:
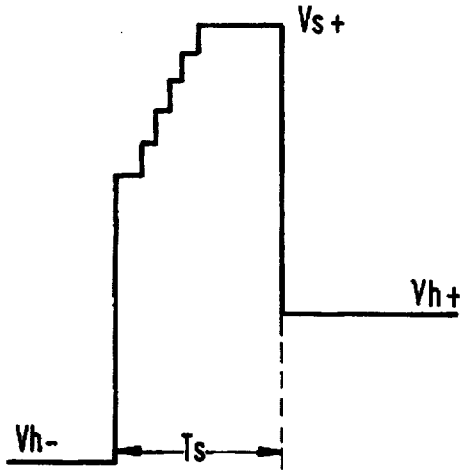
Figure 6C:
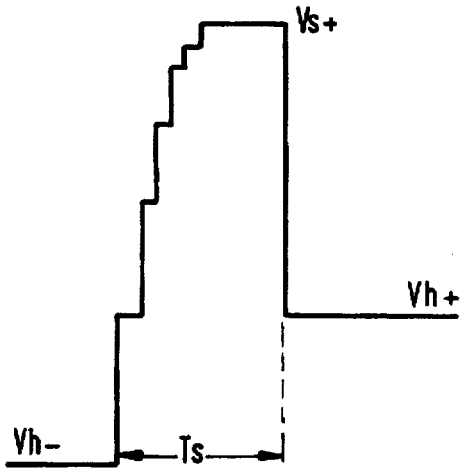

The further examples illustrated in FIGS. 6A, 6B and 6C are similar to those of FIGS. 5A, 5B and 5C respectively except that, rather than being increased smoothly, the voltage level during ramping is increased in staircase fashion by switching to progressively higher voltage levels thereby forming a series of steps.

The maximum level of each pulse signal is preselected and determined by the final voltage which is required for a display element when the voltage on the column conductor drops to zero.

Figure 7:
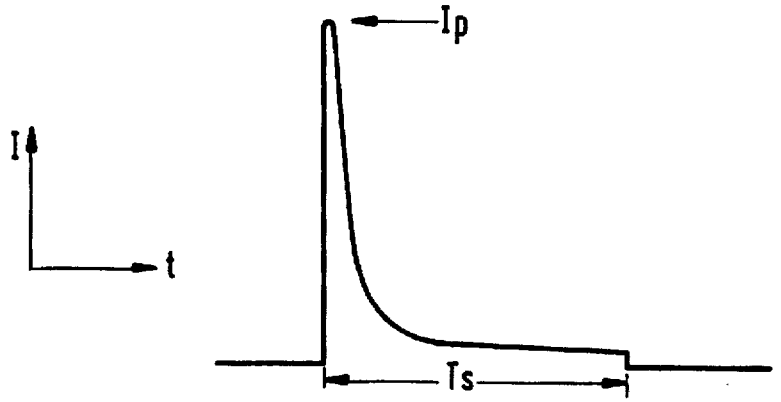
FIG. 7 shows the relationship between electrical current flow in a typical non-linear device associated with a display element and time when addressing a display element using the known row drive waveforms.
Figure 8:
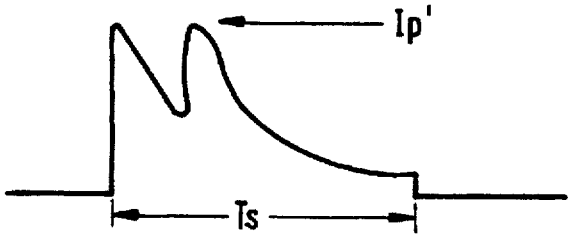
FIGS. 8, 9 and 10 illustrate the relationship between electrical current flowing in a typical non-linear device and time when addressing a display element using the row drive waveforms of FIGS. 4, 5 and 6.
Figure 9:
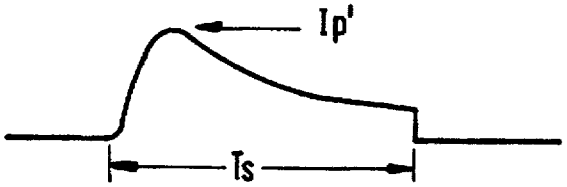
Figure 10:
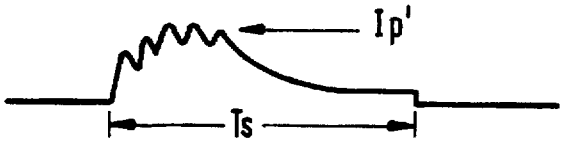

By using such kinds of selection signals, the manner in which the display elements are charged when addressed, including that resulting from a reset signal when this signal is similarly shaped, and the nature of the current flowing through their associated non-linear device in the process, are significantly different from the known drive schemes. FIG. 7 illustrates graphically the relationship between the electrical current flowing in a non-linear device 15 against time when a display element 16 is being charged as the selection signal (or reset signal) is applied to a row conductor 16 which would occur when using conventional row drive waveforms of the kind shown in FIGS. 2 and 3. As can be seen, the current initially rises very sharply to reach a peak Ip. This is because the voltage across the display element capacitance cannot change instantaneously and therefore any change in the voltage between the row and column conductors appears directly across the non-linear device. Thereafter, as the display element capacitance charges, the magnitude of the voltage, and thus the current, drops to a comparatively low level which then remains approximately constant for the remainder of the selection period Ts. For comparison, FIGS. 8, 9 and 10 show graphically the non-linear device currents as a function of time which charge the display element through the same voltage difference in the same time (Ts) when selection (and reset) signals of the kind shown in FIGS. 4, 5 and 6 respectively are used. Clearly, the charging waveforms of FIGS. 8, 9 and 10 have significantly lower peak currents than the charging waveforms of FIG. 7 (i.e. $Ip' \ll Ip$). The kind of current profile (FIG. 8) produced when using a selection (or reset) signal of the type shown in FIG. 4 has two small current spikes compared with the single large spike in the current profile of FIG. 7. The kind of current profile (FIG. 9) produced when using a selection (or reset) signal of the types shown in FIG. 5 has a smaller peak and is distributed more evenly over the selection (or reset) period. The precise position and amplitude of the peak current will depend on the exact shape of the leading edge of the pulse signal. When using selection signals of the types shown in FIG. 6, a similar current profile (FIG. 10) is produced except that the initial peak is replaced by a series of minor peaks.

The reduction in peak current during selection periods, and reset periods when present, is very important to the performance of the display device. It has been known for some time that high peak currents can destroy the non-linear devices. However, it has now also been established that, whilst not necessarily destroying the non-linear device, high peak currents cause an ageing effect in commonly used kinds of non-linear devices leading to a drift in their I-V operational characteristics over a period time of operation and thereby resulting in a change of display performance as described previously. Experiments, for example, on the ageing effects of MIM type thin film diode devices using non-stoichiometric (silicon rich) amorphous silicon alloy material (e.g. $Si_xN_y$) have confirmed the dependency of ageing on the peak current flowing through the device.

An important consideration in deriving these improved row drive waveforms is that, while for a given display element/non-linear device configuration and a given liquid crystal material the total charge which must flow through the non-linear device to achieve a given drive (display) level at the display element cannot be changed, it is possible to modify the current waveform instead. If Q is the charge required to switch the display element into a given transmission state, then the following relationship holds:

where Ts is the selection pulse signal period, and I(t) is the non-linear $$Q=\int_{O}^{Ts} I(t)dt$$

device current at time t. The charge delivered with the waveforms of FIGS. 8, 9 and 10 can be approximately equivalent to that with the waveform of FIG. 7 while at the same time the non-linear devices in the display device where the charging current has a waveform like those of FIGS. 8, 9 and 10 would show considerably less, and much slower, ageing (i.e. drift in I-V characteristics) than those in displays using the conventional row drive waveforms.

Figure 11:
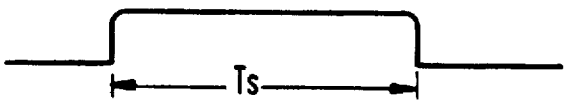
FIG. 11 illustrates a particularly preferable form of the profile of the current flowing in a non-linear device during selection.

FIG. 11 shows a further example of a preferred current profile which could be regarded as an optimum shape for the current waveform. In this, the current is substantially constant and at a comparatively low level throughout the selection period. Such a profile can be approached by optimising the kind of selection signal shaping shown in FIG. 5B and for this reason the type of shaping depicted in FIG. 5B is particularly attractive.

With these new shapes of current waveforms, the display element capacitance will charge as the row address conductor voltage rises therefore reducing the maximum voltage which appears across the nonlinear device during the charging process. Only the leading edges of the selection pulses, and reset pulses if required, need to be modified since this is when the non-linear device starts to conduct. The effect of the modified pulses is to reduce the non-linear device current during the initial part of the charging period. However, in order to ensure that the display element receives the same total charge as it did before, the current must be increased in the later part of the charging period. The consequence of this is that it may be necessary to increase the peak to peak amplitude of the row drive signal when pulse shaping is employed. The magnitude of the increase required, though, is not large.

The optimum shape of the current pulse through the non-linear device 15 is to maintain the charging current substantially constant, at a level $I_{ch}$, during the major part of the selection pulse signal, as illustrated in FIG. 11. If the required change in display element voltage during a period, T, is ΔV then:

$$I_{ch}=C\Delta V/T$$

where Cp is the display element capacitance. If this is to be achieved the voltage across the non-linear device 15 during the selection period must remain substantially constant and so the waveform of the selection pulse must have the same shape as the voltage on the liquid crystal display element 12. Since the display element is a capacitor and the current flowing into it is substantially constant, the voltage waveform on the display element is a linearly rising ramp. The slew rate of this ramp is $I_{ch}/Cp=\Delta V/T$.

The ideal row waveform is like that shown in FIG. 5B and consists of a rapid rise followed by a linear ramp followed by a short period at a constant voltage. The rapid rise takes the voltage across the non-linear device 15 to a level such that it starts to pass the desired, constant current, $I_{ch}$. The ramp then rises at a rate $V_r/T_r$ volts/second where $V_r=\Delta V$. The final, constant, voltage part of the waveform is to ensure that, because there will be small variations in the ramp rate due to component tolerances, the final select voltage reaches a fixed final value. In general this period is made small so that $T_r$ is maximised since this reduces $I_{ch}$.

It will be seen from the above derivation that the value of $I_{ch}$ depends on the value of both ΔV and Cp. These values are different for black and white display elements and, for a TN (Twisted Nematic LC) display using crossed polarisers, they are both larger for black than for white display elements. It is, therefore, not possible to optimise the selection pulse signal shape display elements in an image. In order to minimise the differential drift between display elements driven at different levels the simplest course would be to optimise the ramp amplitude, $V_r$, to obtain a constant charging current for the display elements which are driven hardest.

It should be noted that the optimum value of $V_r$ will, in general, be different for each of the selection pulses and the reset pulse in the 5-level waveform. In some cases however, in order to simplify the drive circuitry, the same ramp amplitude may be used on more than one ramp, e.g. the positive and negative selection pulses. In this case it can only be optimised for one of the pulses.

In experiments in which a display panel employing amorphous silicon nitride MIM type non-linear devices was driven using a five level row drive waveform with the selection and reset pulse signals being of the kind shown in FIG. 4 and in which the selection pulse signal had a period, Ts, of 25 microseconds, a step voltage Vp of 4 volts and a step duration, Tp, of 8 microseconds, it was found that the change in the selection signal voltage level Vs needed to correct for the change in the non-linear device I-V characteristic through ageing during a life test was 60% of that observed when the same display panel was driven using a conventional row drive waveform of the kind shown in FIG. 3.

In experiments in which a display panel employing amorphous silicon nitride MIM type non-linear devices was driven using a five level row drive waveform with the selection and reset pulse signals being of the kind shown in FIG. 5B and in which the selection pulse signal had a period, Ts, of 25 microseconds, a ramp voltage, Vr, of 7 volts, and a ramp time, Tr, of 16 microseconds, it was found that the change in the selection voltage signal level needed to correct for the change in the non-linear device I-V characteristic through ageing during a life test was 33% of that observed when the same display panel was driven using a conventional row drive waveform of the kind shown in FIG. 3.

In the above described examples concerning five level row drive waveforms it has been suggested that both the positive and negative selection pulse signals and the reset pulse signals could all be shaped so as to increase gradually in magnitude in a controlled fashion. However, in certain situations, particularly datagraphic applications where fixed patterns may be displayed for prolonged periods, or in TV displays where, for example, characters or symbols for viewer information purposes may be displayed continously, it can be advantageous to use the pulse shaping techniques in a selective fashion. In preferred embodiment, therefore, the selection signal which follows the reset signal is not shaped in the above-described manner but instead is of generally conventional form, that is substantially rectangular and with a rapid rise time. The difference in drift between a white display element and a black display element in a prolonged display of a stationary picture produces a burn-in effect. By using this particular embodiment of row waveform, such differential drift is reduced.

Figure 12A:
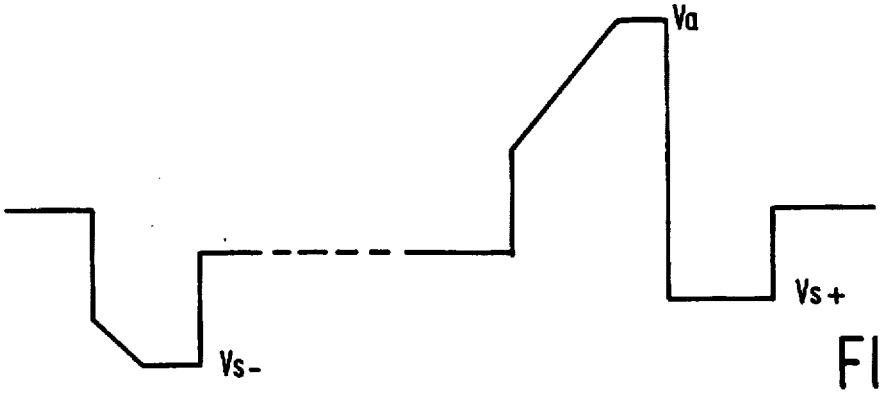
FIGS. 12A–12C illustrates a particular row drive waveform and the resulting current waveforms through the non-linear devices of transmissive (white) and non-transmissive (black) display elements.
Figure 12B:
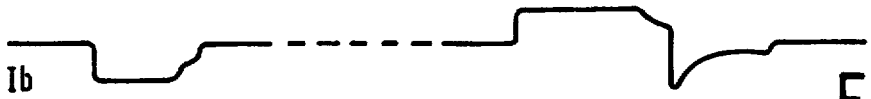
Figure 12C:
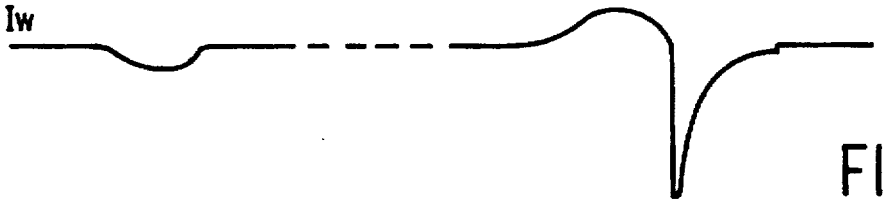

The drift in a non-linear device is related to the current density used to charge its associated display element as well as the magnitude of the charge itself. Because the charge required for a black (non-transmissive) display element is larger than that required for a white (transmissive) display element, assuming TN material is used between crossed polarisers, then a difference in drift will occur between the non-linear device of a black display element and that of a white display element. This difference can be adjusted by changing the pulse shaping used to drive them so as to alter selectively the current waveforms, and control the ageing effects, while the amount of charge transferred to the display elements remains much the same, thereby reducing the difference in ageing between black and white display element non-linear devices to a lower level. The objective is achieved in this embodiment by arranging that the current current density waveforms during selection for the black display elements remains reasonably constant while the current density waveforms for the white display elements is intentionally peaked, and higher than that for the black display elements, for some part of the charging period so that, even though the amount of charge which is transferred to the display element is less than that for a black display element, the extent of ageing effect will be similar. FIGS. 12A and 12B illustrate respectively a part of the row waveform used in this embodiment and the resulting current waveforms through the non-linear devices for black and white display elements, denoted Ib and Iw, during the selection and reset periods. The shapes of the negative selection signal (maximum magnitude $Vs^-$) and the reset signal (maximum magnitude Va) employed are of the kind shown in FIG. 5B, while the positive selection signal (maximum magnitude Vs+) has a conventional shape, that is, substantially rectangular with a very nearly vertical leading edge. The current pulses during the negative selection and reset periods for both black and white display elements are of small peak magnitude with that for the black display element being generally more rectangular, whilst that for the white display elements is only slightly peaked. During the positive selection signal period, however, the current pulse for a white display element has a much larger peak of significantly greater magnitude than that for a black display element. Thus the ageing effects on the non-linear devices of white display elements are deliberately increased. Through such selective control of the current densities, the differential drift, and the burn-in effect caused thereby, is at least considerably reduced even though the amount of charge required for black display elements is larger than that for white display elements.

Other selective implementations of pulse shaping could be used to some advantage in different situations. In another embodiment, therefore, simply the reset selection signal may be shaped so as to increase in magnitude gradually and in controlled manner whilst conventional forms of voltage pulses, i.e. generally rectangular, are used for the other two, positive and negative, selection signals. This would result in a decrease in the overall ageing of the non-linear devices together with some reduction in differential ageing in certain circumstances.

Turning now to the manner in which the forms of the selection pulse signals depicted in FIGS. 4, 5 and 6 are generated, various alternative approaches are possible. The row drive circuit 20 may, for example, comprise a custom-designed row drive integrated circuit that generates internally outputs of the appropriate drive waveform.

However, another approach enables a number of currently available row drive circuits in integrated circuit form used to provide four and five level row drive waveforms to be employed. In these known circuits, the multi-level, e.g. five level, row drive waveform is typically generated by connecting the output pin associated with a row address conductor to one of a number of voltage lines at different voltage levels by means of analog switches operating in a predetermined sequence. The voltages on these lines are supplied from a power supply source. In the embodiment of in FIG. 1, this source is included in the timing and control circuit 25. An example of a typical single output stage of one such integrated circuit row drive circuit, namely an FC 2278 row driver IC, designed to produce a five level row drive waveform is shown schematically in FIG. 13. Such row driver ICs operate as complex analogue multiplexers. Each of the row driver output stages consists of a five input multiplexer, the inputs being connected to voltage lines V1 to V5 that determine the five levels in the output waveform. S1 to S5 are analogue switches and only one of these is closed at any instant, namely S1 in the case of FIG. 13, generating an output voltage level V1. The switches are operated in sequence by a control logic circuit, the part of this circuit associated with the stage illustrated in FIG. 13 being indicated at 30. Normally, the voltage lines V1 to V5, each connected to a respective one of the switches, correspond to the D.C. voltages required to generate the reset, the hold and the selection voltage levels of the waveform of FIG. 3.

Figure 15:
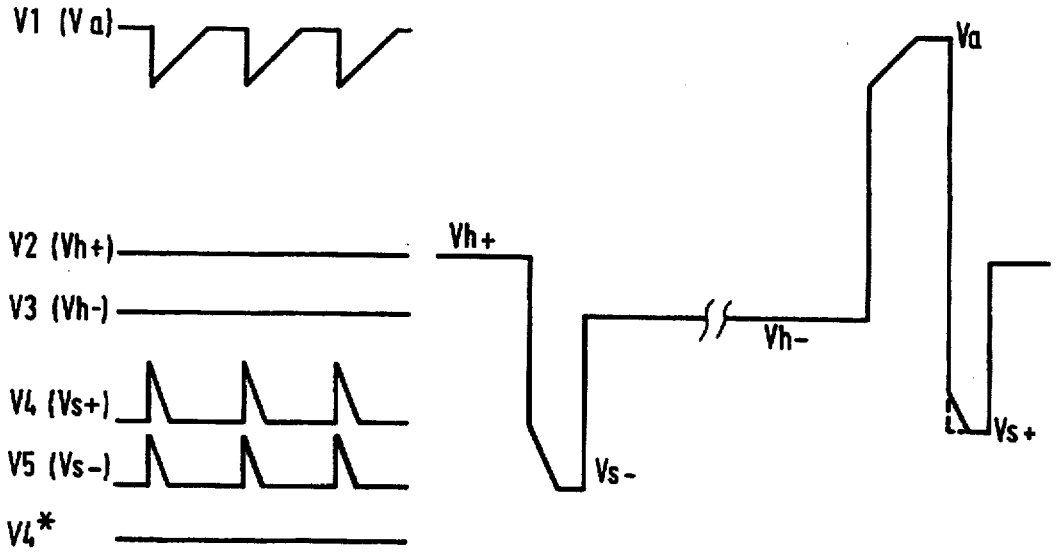
FIG. 15 illustrates the relationship between various voltage levels used in the circuit of FIG. 13 and an example output waveform.

In order to generate the shaped pulses for the row drive waveforms having the kind of selection signals and reset signals shown in FIGS. 4, 5 and 6, some or all of the D.C. levels corresponding to the selection and reset voltages can be replaced by a varying signal as appropriate for the particular kind of pulse signal required. An example set of voltages for the generation of a row drive waveform equivalent to that comprising selection and reset pulse signals of the kind shown in FIG. 5B is illustrated in FIG. 15, which also shows a typical portion of the outputted row drive waveform resulting therefrom for supply to a row address conductor 16. The production of the shaped pulses requires only the generation and addition of an appropriate modulating waveform to the existing voltages fed to the row drive circuit. An advantage of this approach is that the shape of the waveform can easily be adjusted to give the maximum possible reduction in drift. It is simply necessary to generate an appropriate modulating waveform synchronised to the row driver clock. The V2 and V3 levels, defining the Vh+ and Vh− hold levels, remain constant. The varying voltage signals V1, V4 and V5, defining the reset, Va, and positive and negative selection signals, Vs+ and Vs−, supplied to the row drive circuit may be generated by analog circuits in which case the final row drive waveforms will be equivalent to those of FIG. 5 or may be generated by digital to analog converters in which case the final row drive waveforms will be equivalent to those of FIG. 6. The stepped pulse signals of FIG. 4 may be generated comparatively simply by switching the appropriate voltage inputs to the row driver circuit between only two levels. To produce the kind of waveform shown in FIG. 12A, the V4 input comprises instead a constant level (Vs+), as shown at V4* in FIG. 15. The resulting change to the form of the positive selection signal of the waveform is shown in dotted outline.

Figure 14:
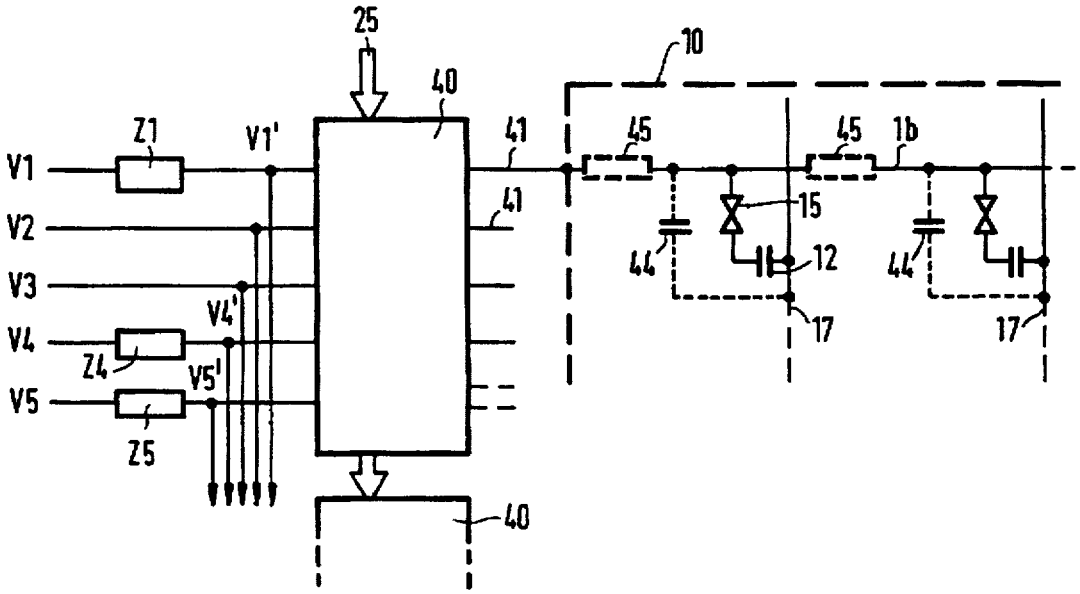
FIGS. 13 and 14 illustrate schematically parts of two different embodiments of drive circuit used in the display device for providing the row drive waveforms.
Figure 16:
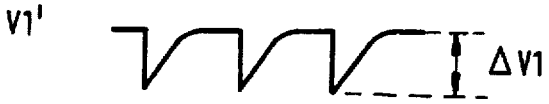
FIG. 16 illustrates a voltage waveform in the circuit of FIG. 14.

Another way of generating selection pulse signals with the sloping leading edges in both four and five level row waveforms, and reset signals with a sloping leading edge in the latter case is to introduce a series impedance into some of the voltage lines V1 to V5 at the input to the row drive integrated circuit as appropriate for the particular waveform required. A part of a row drive circuit using this approach and generating a five level waveform is illustrated schematically in FIG. 14. The circuit includes a conventional row driver integrated circuit, 40, having a plurality of outputs 41 connected to respective row address conductors 16 of the display panel 10, only one of which conductors is shown for simplicity. Because a large number of row address conductors are used in display panels of this kind, a plurality of identical row drive integrated circuits is used in practice with each circuit being connected to a respective group of row address conductors. The row drive integrated circuits 40 are preferably mounted on the substrate of the display panel 10 carrying the row conductors 16 using chip-on-glass technology with their outputs 41 connected to respective row conductors 16. Timing signals are supplied to the circuits from the timing and control unit 25 (FIG. 1) which also provides predetermined voltage levels to the circuit 40 via the voltage lines V1 to V5. The voltage levels on lines V1 to V5 define the reset voltage pulse signal level Va, the positive and negative hold levels Vh+ and Vh−, and the positive and negative selection pulse signal levels Vs+ and Vs− in the case of a five level row drive waveform being required. In the circuit shown the voltage lines V1, V4 and V5, providing the Va, Vs+ and Vs− levels respectively, are connected to the circuit 40 via respective series impedances Z1, Z4 and Z5. The circuit 40 comprises switches operated by the timing and control signals supplied by the unit 25 to supply the required row drive waveform to each of its outputs 41, and hence the row conductors 16, by connecting an output 41 to the voltage lines V1 to V5 in a predetermined sequence and for the required periods. As each row of display elements 12 is addressed, its associated row address conductor 16 is connected to the appropriate voltage line. Considering, for example, the period when a row address conductor 16 is connected to the voltage line V1, defining the Va+ reset signal level, then the inrush current required to charge the display elements connected to that row address conductor, and any parasitic capacitances which may be present as represented in FIG. 14 by respective capacitors 44 connected in parallel with a display element 12 and its non-linear device produces a voltage drop across the impedance Z1 which causes the voltage, V1', at the input to the circuit 40 to fall to a level below V1. As display elements in the row charge, the current falls and the voltage V1' rises back towards V1. This is shown in FIG. 16 which depicts the nature of the V1' voltage waveform at the input to the row drive circuit 40. The result is that the output from the row drive circuit 40 to the row conductor 16 has a form similar to that of FIG. 5C. The detailed shape of the ramped part of the waveform depends upon the display panel characteristics and the nature of the series impedance Z1. The display panel characteristics are determined not only by the behaviour of the non-linear devices, the nature of the display elements and the parasitic capacitances 44 but also by other factors such as the inherent resistance of the row address conductor lines, as represented by resistors 45 in FIG. 13. For a given display panel, the impedance Z1 can be adjusted to alter the amplitude ΔV1 and the length of the step in V1.

The impedances Z4 and Z5 cause a similar effect to the shaping of the selection pulse signals Vs+ and Vs− determined by the voltage lines V4 and V5 when the row drive circuit 40 switches to connect the row address conductor to the lines V4 and V5 to generate these components of the row drive waveform such that the voltages V4' and V5' at the inputs to the row drive circuit 40 vary in similar manner as that shown in FIG. 16.

In the case where a waveform of the kind depicted in FIG. 12A is desired, then the series impedance in the V4 supply line is omitted.

The impedances Z1, and Z5, and Z4 if used, can take several forms, a resistor and a current source being two of the simplest examples.

It is to be noted that the voltage lines V1, V4 and V5 are connected to the other row driver integrated circuits 40 via connections established at points between the impedances Z1, Z4 and Z5 and the first circuit 40 rather than at points in these voltage lines prior to the impedances and with separate impedances Z1, Z4 and Z5 being used for each circuit 40. This is important as it ensures that the shape of the reset and selection pulse signals of the row drive waveform applied to every row address conductor is determined by the same impedances as well as the same voltage lines so that the row drive waveforms produced for all row address conductors are substantially identical with regard to the voltage levels and the shape of their selection and reset pulse signals.

For similar reasons, the embodiment of row drive circuit of FIG. 14 has advantages over the provision of impedances in the part of the circuit between the row driver circuit outputs 41 and the non-linear devices of the display panel. For example, it might be thought that a similar effect could be achieved by introducing a resistor in series with the non-linear device 15 at each display element 12 location or by placing a resistor in series between an output 41 of the row drive circuit 40 and its associated row address conductor 16. While these two approaches could indeed reduce the peak current through the non-linear devices in the selection and reset signal periods, they would be difficult to implement technologically in view particularly of the need to form them accurately and reliably. In order to have the required effect, a series resistor at each display element location would have to have a very large value, typically greater than 1 Mohm for example. Such resistors are difficult to fabricate reliably and uniformly using conventional thin film technology as employed for fabricating the row address conductors, non-linear devices and display element electrodes of the display panel, and, additionally, would occupy valuable display element area, thereby reducing the available optical aperture of a display element. Providing a series resistor between each row address conductor 16 and its associated output 41 of the row drive circuit 40 would pose similar problems. The resistance values required would typically have to be in the range 1–100 Kohm depending on the display panel size and type. These resistors would need to be very accurately matched in value from row to row as any slight variation in their values would result in non-uniformity in the display which would be immediately noticeable.

The techniques for generating the required row drive waveforms described above with reference to FIGS. 13 and 14 are advantageous, therefore, in that the desired limiting of the peak current through the non-linear devices is achieved in a simple and convenient manner which does not affect the display panel technology is any way.

Figure 13:
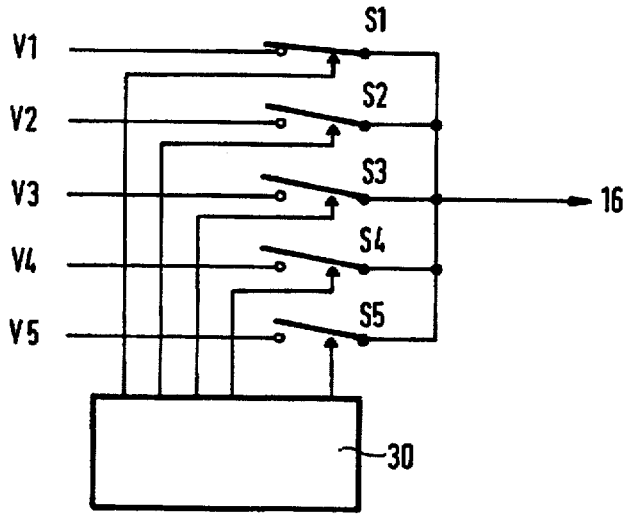

Although in the above described embodiments a five level row drive waveform is referred to in particular, it will be appreciated that a four level row drive waveform can be used instead and to this end the voltage line V5 in FIGS. 13 and 14 would be omitted.

The non-linear devices 15 need not be amorphous silicon nitride MIM type devices but could comprise other types of thin film diode devices as described previously which suffer from drift effects in a similar manner.

The matrix display device may be a black and white or a colour display device. Moreover, although the method has been described in relation to a display device comprising liquid crystal display elements, it is envisaged that the method can be used with display devices employing other kinds of electro-optic materials, for example, electrochromic or electrophoretic materials.

From reading the present disclosure, other modifications will be apparent to persons skilled in the art. Such modifications may involve other features which are already known in the field of matrix display devices and their methods of driving and which may be used instead of or in addition to features already described herein.

We claim:

1. A method of driving an active matrix display device having sets of row and column address conductors and an array of electro-optic display elements operable to produce a display each of which is connected in series with a two terminal non-linear device between a row address conductor and a column address conductor, in which a selection voltage signal is applied to each row address conductor during a row selection period to select a row of display elements and data voltage signals are applied to the column address conductors whereby the selected display elements are driven to voltage levels according to the data voltage signals, characterised in that the selection signal supplied to a row address conductor comprises a voltage pulse signal whose magnitude increases gradually in a controlled fashion to a maximum selection voltage amplitude during the row address period.

2. A method according to claim 1, characterised in that the selection signal comprises a voltage pulse signal whose rising edge is stepped.

3. A method according to claim 2, characterised in that the rising edge of the voltage pulse signal comprises a plurality of steps at progressively high voltage levels.

4. A method according to claim 3, characterised in that the voltage pulse signal initially increases rapidly to a predetermined level below the maximum amplitude level and thereafter is increased in steps to the maximum level.

5. A method according to claim 1, characterised in that the selection signal comprises a voltage pulse signal whose rising edge is ramped smoothly.

6. A method according to claim 5, characterised in that the voltage pulse signal initially increases rapidly to a predetermined level below the maximum amplitude level and is thereafter increased to the maximum level by ramping.

7. A method according to claim 5 or 6, characterised in that the rising edge of the voltage pulse signal is ramped substantially linearly.

8. A method according to claim 5 or claim 6 characterised in that the rising edge of the voltage pulse signal is ramped non-linearly.

9. A method according to claim 1, characterised in that the voltage pulse signal is held at substantially the maximum amplitude level for a preselected period comprising a latter part of the duration of the selection signal.

10. A method according to any one of the preceding claims, characterised in that the selection signal comprises part of a row drive waveform applied to each row address conductor which further includes a second selection voltage signal and a reset voltage signal which prior to the application of the second selection voltage signal that is operable to drive a selected display element to a voltage of a certain sign for display purposes charges the display element to an auxiliary voltage level of the same sign which lies at or beyond the range of voltage levels used for display purposes, in that the reset signal similarly comprises a voltage pulse signal whose magnitude increases gradually in a controlled fashion to a predetermined maximum voltage amplitude, and in that the second selection signal which follows the reset signal comprises a generally rectangular voltage pulse signal whose leading edge increases comparatively rapidly to a predetermined maximum amplitude.

11. A method according to claim 1, characterised in that the selection signal comprises part of a row drive waveform applied to each row address conductor which further includes a second selection voltage signal and a reset voltage signal which prior to the application of the second selection voltage signal that is operable to drive a selected display element to a voltage of a certain sign for display purposes charges the display element to an auxiliary voltage level of the same sign which lies at or beyond the range of voltage levels used for display purposes, and in that the second selection voltage signal and the reset voltage signal similarly comprise voltage pulse signals whose magnitudes increase gradually in a controlled fashion to a predetermined maximum voltage amplitude.

12. A method according to claim 1, characterised in that a row drive waveform is applied to each row address conductor which comprises a first selection signal that is operable to drive a selected display element to a voltage of a first polarity for display purposes, a second selection signal that is operable to drive the display element to a voltage of opposite polarity for display purposes, and a third, reset, selection signal which precedes said second selection signal and is operable to charge the display element to an auxiliary voltage level of said opposite polarity which lies at or beyond the range of voltage levels used for display purposes, and in that said selection signal whose magnitude increases gradually in a controlled fashion comprises said third, reset selection signal.

13. A method according to claim 1, characterised in that the polarity of the selection signal is inverted for successive fields.

14. An active matrix display device comprising sets of row and column address conductors, an array of electro-optic display elements operable to produce a display, each of which is connected in series with a two-terminal non-linear device between a row address conductor and a column address conductor, and a drive circuit connected to the sets of row and column address conductors for applying a selection voltage signal to each row address conductor during a row address period to select a row of display elements and data signals to the column address conductors by means of which the selected display elements are driven to voltage levels according to the data voltage signals, characterised in that the drive circuit is adapted to provide selection voltage signals for supply to the row address conductors which comprise a voltage pulse signal whose magnitude increases gradually in a controlled fashion to a maximum selection voltage amplitude during the row address period.

15. An active matrix display device according to claim 14, characterised in that the drive circuit includes a row drive circuit which provides for each row address conductor a drive waveform comprising a succession of selection signals that are separated by a non-selection voltage level and in which the polarity of successive selection signals is inverted.

16. An active matrix display device according to claim 14, characterised in that the drive circuit includes a row drive circuit which provides for each row address conductor a row drive waveform which in addition to said selection voltage signal includes a second selection signal and a reset selection signal preceding the second selection signal which prior to the application to the row address conductor of the second selection signal that is operable to drive a selected display element to a voltage of a certain sign for display purposes is operable to charge the display element to an auxiliary voltage level of the same sign which lies at or beyond the range of voltage levels used for display purposes, in that the reset signal similarly comprises a voltage pulse signal whose magnitude increases gradually in an controlled fashion to a maximum voltage amplitude, and in that the second selection signal comprises a generally rectangular voltage pulse signal whose leading edge increases comparatively rapidly to a predetermined maximum amplitude.

17. An active matrix display device according to claim 14, characterised in that the drive circuit includes a row drive circuit which provides for each row address conductor a row drive waveform which comprises a first selection signal for driving a selected display element to a voltage of a first polarity for display purposes, a second selection signal for driving the display element to a voltage of opposite polarity for display purposes, a third, reset, selection signal prior to the second selection signal for charging the display element to an auxiliary voltage of said opposite polarity whose level lies at or beyond the range of voltages used for display purposes, and in that the selection signal whose magnitude increases gradually in a controlled fashion comprises the reset selection signal.

18. An active matrix display device according to claim 14 characterised in that the drive circuit includes a row drive circuit which provides for each row address conductor a row drive waveform which in addition to said selection voltage signal includes a second selection signal and a reset selection signal preceding the second selection signal which prior to the application to the row address conductor of the second selection signal that is operable to drive a selected display element to a voltage of a certain sign for display purposes is operable to charge the display element to an auxiliary voltage level of the same sign which lies at or beyond the range of voltage levels used for display purposes and in that the reset signal and the second selection signal similarly comprise voltage pulse signals whose magnitudes increase gradually in a controlled fashion to a maximum voltage amplitude.

19. An active matrix display device according to claim 16, 17 or 18, characterised in that the selection voltage signal provided by the row driver circuit has a magnitude which increases gradually in a controlled fashion in the form of a voltage pulse signal which has a rising edge that increases rapidly to a predetermined level below the maximum amplitude level and thereafter gradually increases to said maximum.

20. An active matrix display device according to claim 14, characterised in that the two-terminal non-linear devices comprise thin film diode devices.

21. An active matrix display device according to claim 14, characterised in that the electro-optic display elements comprise liquid crystal display elements.

* * * * *

UNITED STATES PATENT AND TRADEMARK OFFICE

CERTIFICATE OF CORRECTION

PATENT NO. : 5,684,501 
DATED : November 4, 1997
INVENTOR(S) : Alan G. Knapp, John M. Shannon, Alexander D. Annis and Jeremy N. Sandoe It is certified that error appears in the above-identified patent and that said Letters Patent is hereby corrected as shown below:

Column 17,
Line 49, change "any one of the preceding Claims" to -- Claim 1 --.

Signed and Sealed this

Eighth Day of October, 2002

*Attest:*

*Attesting Officer*

JAMES E. ROGAN
*Director of the United States Patent and Trademark Office*